US009776229B2

(12) United States Patent
Kurz et al.

(10) Patent No.: US 9,776,229 B2
(45) Date of Patent: Oct. 3, 2017

(54) METHOD FOR INFLUENCING THE GEOMETRY OF A ROLLED ITEM IN A CONTROLLED MANNER

(71) Applicant: SIEMENS AKTIENGESELLSCHAFT, Munich (DE)

(72) Inventors: Matthias Kurz, Erlangen (DE); Birger Schmidt, Brand-Erbisdorf (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 0 days.

(21) Appl. No.: 14/417,611

(22) PCT Filed: Jun. 13, 2013

(86) PCT No.: PCT/EP2013/062219
§ 371 (c)(1),
(2) Date: Jan. 27, 2015

(87) PCT Pub. No.: WO2014/016045
PCT Pub. Date: Jan. 30, 2014

(65) Prior Publication Data

US 2015/0231679 A1 Aug. 20, 2015

(30) Foreign Application Priority Data

Jul. 27, 2012 (EP) ..... 12178145

(51) Int. Cl.
*B21B 13/06* (2006.01)
*B21B 37/58* (2006.01)
*B21B 39/14* (2006.01)

(52) U.S. Cl.
CPC ..... *B21B 37/58* (2013.01); *B21B 13/06* (2013.01); *B21B 39/14* (2013.01)

(58) Field of Classification Search
CPC ..... B21B 37/68; B21B 37/70; B21B 2273/04; B21B 2273/12; B21B 2273/14;
(Continued)

(56) References Cited

U.S. PATENT DOCUMENTS 5,284,284 A * 2/1994 Narishima ..... B21C 47/3416 226/15
6,000,259 A * 12/1999 Wolters ..... B22D 11/1206 72/10.4
(Continued)

FOREIGN PATENT DOCUMENTS

CN 101274334 10/2008
CN 101602065 12/2009
(Continued)

OTHER PUBLICATIONS

European Office Action for European Priority Application No. 12178145.4, issued Jan. 17, 2013, 5 pages.
(Continued)

*Primary Examiner* — Edward Tolan
(74) *Attorney, Agent, or Firm* — Staas & Halsey LLP

(57) ABSTRACT

A method influences the geometry of a rolled item in a controlled manner. In the method, the rolled item is transformed from an initial condition into an intermediate or final condition by rolling with the aid of a rolling stand having at least one processing assembly. An improvement in the geometry of the rolled item, particularly during processing of asymmetric rolled items, is achieved in that the at least one processing assembly is operated in a force-controlled manner on the basis of a desired force.

9 Claims, 1 Drawing Sheet

(58) Field of Classification Search
CPC ..... B21B 2273/16; B21B 2273/18; B21B 2273/20; B21B 13/06; B21B 37/00; B21B 37/22; B21B 37/30; B21B 37/58; B21B 37/60; B21B 37/62; B21B 39/14
USPC ..... 72/10.4, 8.1
See application file for complete search history.

(56) References Cited

U.S. PATENT DOCUMENTS

| | | | | |
|---|---|---|---|---|
| 8,429,943 | B2 | 4/2013 | Jepsen et al. | |
| 8,490,447 | B2 * | 7/2013 | Kurz | B21B 37/28 72/11.6 |
| 8,616,034 | B2 * | 12/2013 | Tuschhoff | B21B 37/68 72/10.1 |
| 2012/0167653 | A1 * | 7/2012 | Benner | B21B 39/14 72/250 |

FOREIGN PATENT DOCUMENTS

| | | | | | |
|---|---|---|---|---|---|
| CN | 102049418 | | | 5/2011 | |
| CN | 102245322 | | | 11/2011 | |
| EP | 12178145.4 | | | 7/2012 | |
| EP | 2666558 | | | 11/2013 | |
| JP | 62-57705 | A | * | 3/1987 | B21B 37/00 |
| JP | 63-10018 | A | * | 1/1988 | B21B 37/00 |
| JP | 2-104402 | A | * | 4/1990 | B21B 13/06 |
| JP | 2-280905 | | | 11/1990 | |
| JP | 3-230804 | A | * | 10/1991 | B21B 37/00 |
| JP | 5-42305 | A | * | 2/1993 | B21B 13/06 |
| JP | 6-63622 | A | * | 3/1994 | B21B 37/00 |
| JP | 2001-47120 | | | 2/2001 | |
| SU | 456652 | | | 2/1975 | |
| SU | 977079 | | | 12/1982 | |
| WO | 2006/119984 | | | 11/2006 | |
| WO | 2009/016086 | | | 2/2009 | |
| WO | 2011/080226 | | | 7/2011 | |
| WO | PCT/EP2013/062219 | | | 6/2013 | |

OTHER PUBLICATIONS

English language International Search Report for PCT/EP2013/062219, mailed Sep. 24, 2013, 2 pages.
Chinese Office Action for related Chinese Patent Application No. 201380039609.3, issued Sep. 6, 2015, 5 pages.
Russian Office Action dated Apr. 20, 2017 in corresponding Russian Patent Application No. 2015103124/02(004954), 10 pages.

* cited by examiner

METHOD FOR INFLUENCING THE GEOMETRY OF A ROLLED ITEM IN A CONTROLLED MANNER

CROSS REFERENCE TO RELATED APPLICATIONS

This application is based on and hereby claims priority to International Application No. PCT/EP2013/062219 filed on Jun. 13, 2013 and European Application No. 12178145.4 filed on Jul. 27, 2012, the contents of which are hereby incorporated by reference.

BACKGROUND

The invention relates to a method for influencing the geometry of a rolled item in a controlled manner, said rolled item being transformed from an initial state into an intermediate or final state by rolling with the aid of a rolling stand by at least one processing assembly. The invention further relates to an open-loop and/or closed-loop control device, a machine-readable program code and a data medium.

All of the systems required to produce rolled products can be combined in a rolling mill. A distinction is made between hot-rolling mills and cold-rolling mills, depending on the type of forming. In hot-rolling mills or hot-rolling broad-strip mills, roughed slabs or ingots, usually referred to simply as slabs, are processed into hot strip. This hot working is one of the methods which follow the primary forming (ingot casting, continuous casting). The rolled item is heated to temperatures up to 1,350° C. in this case, and reduced to a predetermined thickness in a roll gap of the rolling mill by pressure while preferably remaining above its recrystallization temperature. Since the finished product (usually steel or aluminum strip) can rarely be rolled out in a single pass, a plurality of rolling stands are combined to form a mill train in which a plurality of reduction stages are performed according to the number of stand passes. In hot-rolling mills, a distinction is made between a roughing train and a finishing train, the slab being preprocessed in the roughing train before then being rolled out to its final dimensions in the finishing train, which usually comprises five, six or seven stands.

One of the problems that occurs when rolling slabs, or the strips derived therefrom, is that the item to be rolled in a roughing train has a thickness curve across its width. The purpose of rolling is usually to produce strips which at the end of the finishing train have not only a thickness across their width which is substantially symmetrical relative to the strip center, i.e. an absence of taper, but also minimal deformation along the length of the rolled item, i.e. an absence of strip saber.

However, this is difficult to achieve if an item to be rolled already has a tapered shape when rolled for the first time within the hot-rolling mill train. The taper of the rolled item is generally caused by the casting process and the subsequent cooling and further processing, in particular halving, of the cast slabs. If a tapered rolled item must then be rolled out into a slab having a substantially rectangular cross section, the volume retention causes greater material flow (in particular longitudinal flow) on the "thick" side of the slab than on the "thin" side of the slab. This differing material flow in a longitudinal direction of the rolled item results in the formation of a longitudinal curvature or strip saber. Depending on the nature of the strip saber, a rolled item having longitudinal curvature can result in difficulties during subsequent processing of the rolled item. The formation of the strip saber may be so pronounced that further processing of the rolled item is impossible.

Various methods are customarily used to deal with a taper or longitudinal curvature of a rolled item in a mill train. These methods are generally based on an asymmetrical distribution of tension at the roll gap, wherein a force is generated transversely relative to the direction of rolling.

Position-controlled processing assemblies for applying a transverse force are also known, e.g. lateral guides as described in WO2006/119984 or vertical stands (so-called edgers) for width control.

SUMMARY

One possible object is to allow an improvement in the geometry of a rolled item, particularly when processing asymmetrical rolled items.

The inventors propose a method for influencing the geometry of a rolled item in a controlled manner, in particular a rough strip, wherein said rolled item is transformed from an initial state into an intermediate or final state by rolling with the aid of a rolling stand, in particular a roughing stand, by at least one processing assembly, and the at least one processing assembly is operated in a force-controlled manner on the basis of a reference force.

In this context, a processing assembly is understood to be in particular a vertical stand (edger), a lateral guide or a transverse force device as described by the patent application "Seitenführung für eine Walzstraβe" having the application reference number 12168684.4 and submitted on 21 May 2012.

The proposals are based on the finding that an asymmetrical curve of the rolled item can be counteracted particularly successfully by a suitably selected force, which is applied to the rolled item by the processing assembly. This force is defined by the reference force, and the reference force is a constant force or alternatively a force sequence which varies over time. The position control of the at least one processing assembly as used previously is unsuitable for operating the processing assembly in this case. Instead, the processing assembly exerts a defined transverse force on the rolled item by the force control, thereby influencing the curvature of the material. It is consequently possible by the force control of the at least one processing assembly to process a rolled item which is asymmetrical in respect of its thickness and/or width in such a way that the asymmetry is eliminated or at least largely reduced. The force control can also be effected in conjunction with subsidiary position control, i.e. the position is used in a second superimposed control loop to control the reference force. Such cascade controls are known to a person skilled in the art.

If two processing assemblies are provided, i.e. one on either side of the rolled item as seen in the direction of rolling, one processing assembly is preferably operated in a force-controlled manner and the other in a position-controlled manner. In this case, the position-controlled processing assembly preferably tracks the force-controlled processing assembly such that a midpoint between the two processing assemblies always remains at a predetermined position. If the reference force to be applied is overestimated, force control alone may result in unwanted distortion of the rolled item material, wherein the longitudinal curvature changes its direction. In order to avoid this, the position-controlled processing assembly is moved closer to the rolled item and absorbs the excess force of the force-controlled processing assembly. The tracking of the position-controlled processing assembly is implemented by control engineering, such that the midpoint between the two processing assemblies does not move, but in particular always remains at the same position. It may be appropriate for the midpoint between the two processing assemblies to deviate from a centerline of the rolling stand in this case, but it may also lie on the centerline of the rolling stand.

According to a preferred variant, the midpoint between the processing assemblies and a separation between the processing assemblies are used for the purpose of controlling the processing assemblies. The midpoint between the processing assemblies is preferably predetermined and the force control of one of the processing assemblies is performed by adjusting the separation between the processing assemblies. This type of force control, in which the midpoint and the separation between the two processing assemblies are the control variables, is particularly easy to implement. Since the midpoint in particular remains constant, only the separation between the two processing assemblies is changed in order to generate the desired reference force. In this case, if the force-controlled processing assembly moves, it is tracked by the position-controlled processing assembly in order to compensate for any possible excess reference force.

The force control cannot be performed until material is situated in the region of the processing assembly. Therefore the at least one processing assembly is preferably moved up to the rolled item in a position-controlled manner initially, and is then switched over to the force control when the reaction force acting on the processing assembly reaches the reference force. In the case of two parallel processing assemblies, positioned on either side of the rolled item, this means that the separation between the processing assemblies is initially reduced in a position-controlled manner. As the processing assemblies move closer together, the reaction force exerted by the rolled item on the processing assemblies increases. When the reaction force acting on the processing assembly on the "thin" side of the rolled item or on the side with the least material flow has reached the reference force, the position control of this processing assembly is switched over to force control, such that the above-described operations are performed.

According to a preferred embodiment, the taper and/or the longitudinal curvature of the rolled item is measured, in the initial state in particular, and the reference force for the force control is determined on this basis. When the reference force has been determined and the midpoint is known, the separation between the processing assemblies is calculated and supplied to the processing assemblies as a control variable.

During the rolling operation, the geometry of the rolled item can change such that the taper or longitudinal curvature changes its side or direction. If such a change occurs in the position of the taper and/or the direction of the longitudinal curvature of the rolled item, a change advantageously takes place between the force-controlled processing assembly and the position-controlled processing assembly. This means that if the longitudinal curvature changes its direction during the rolling operation, with effect from the reversal point, the processing assembly which was previously operated in a force-controlled manner is operated in a position-controlled manner after the change, and the processing assembly which was previously operated in a position-controlled manner is operated in a force-controlled manner.

The inventors also propose a control device for influencing the geometry of a rolled item in a controlled manner, having a machine-readable program code which contains control instructions that cause the open-loop and/or closed-loop control device to perform the method according to one of the above embodiments.

The inventors further propose a machine-readable program code for an open-loop and/or closed-loop control device for influencing the geometry of a rolled item in a controlled manner, said program code containing open-loop and/or closed-loop control instructions which cause the open-loop and/or closed-loop control device to perform the method according to one of the above embodiments.

Finally, the inventors propose a data medium on which such a machine-readable program code is stored.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
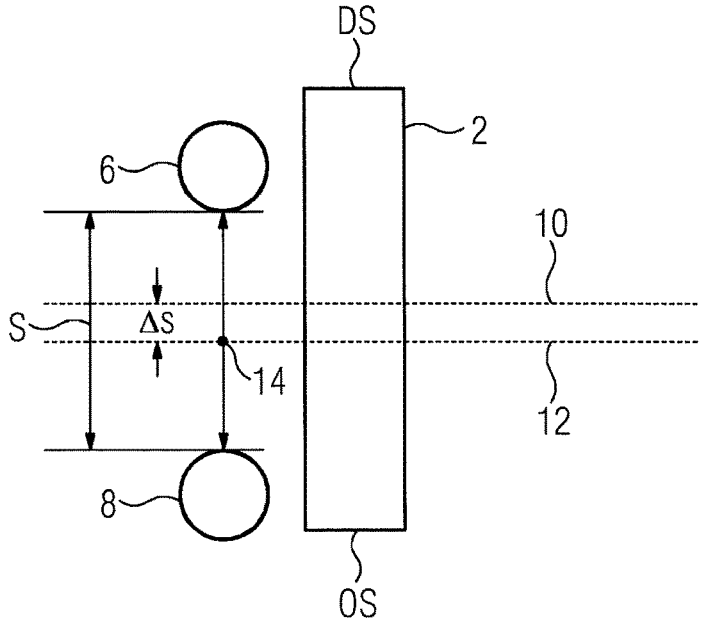
FIG. 1 schematically shows a greatly simplified first plan view of a rolling stand with two lateral processing assemblies, and FIG. 2 schematically shows a greatly simplified second plan view of a rolling stand with two lateral processing assemblies.

Reference will now be made in detail to the preferred embodiments of the present invention, examples of which are illustrated in the accompanying drawings, wherein like reference numerals refer to like elements throughout.

Figure 2:
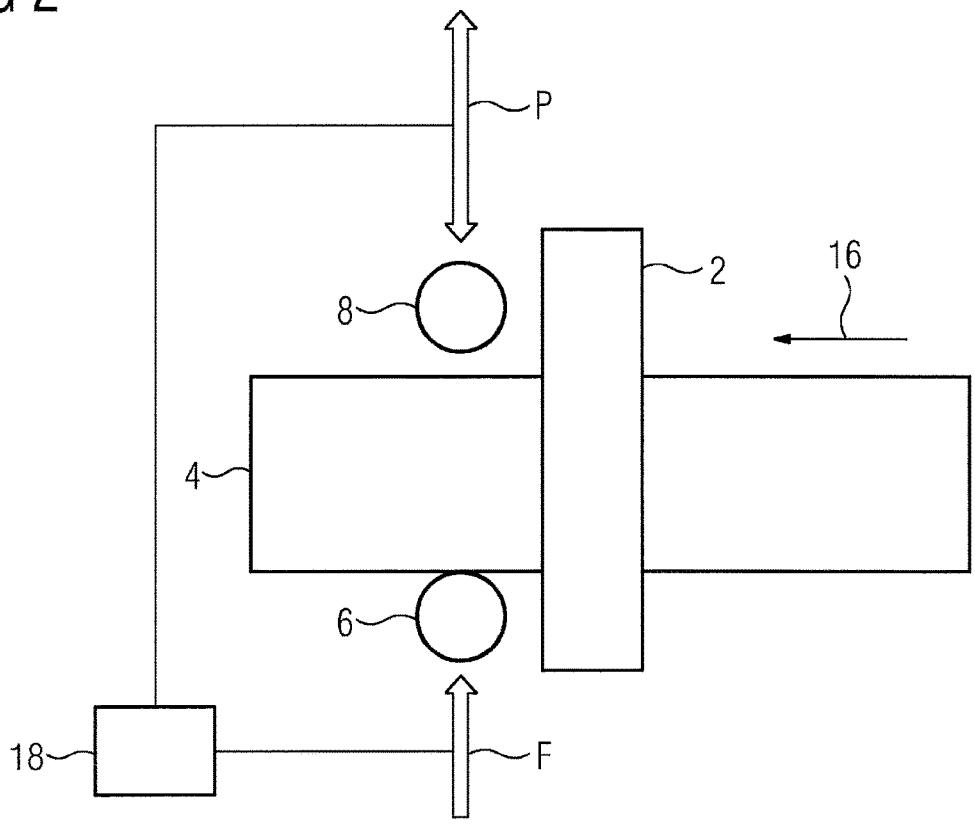

FIG. 1 and FIG. 2 show a horizontal rolling stand 2, in particular a roughing stand, by which a rolled item 4, in particular a rough strip, is rolled such that the rolled item 4 is transformed from an initial state into an intermediate or finished state. The rolling stand 2 has a drive side DS and an operator side OS.

In addition, two processing assemblies 6, 8 are assigned to the rolling stand 2, being positioned on either side of the rolled item 4 as shown in FIG. 2. The separation between the processing assemblies 6, 8 is designated as S in FIG. 1. Also shown in FIG. 1 is a centerline 10 of the rolling stand 2, a centerline 12 between the processing assemblies 6, 8, and a midpoint 14 between the processing assemblies 6, 8, wherein said midpoint 14 lies on the centerline 12. An offset between the two centerlines 10 and 12 is designated as $\Delta s$.

In particular, the rolling stand 2 operates in reversible mode in the exemplary embodiment shown here, such that the rolled item 4 can change its rolling direction 16 many times during operation.

In the situation shown in FIG. 2, the processing assemblies 6, 8 are arranged behind the rolling stand 2 in the rolling direction 16. The function of the processing assemblies 6, 8 is to restrict an asymmetrical geometry of the rolled item 4 being rolled. To this end, if a taper and/or a longitudinal curvature of the rolled item 4 is detected, provision is made for operating one of the processing assemblies 6, 8 (the processing assembly 6 in the exemplary embodiment according to FIG. 2) in a force-controlled manner, as indicated by the reference force signal F. At the same time, the second processing assembly 8 is operated in a position-controlled manner, as indicated by the position signal P. The closed-loop control of both processing assemblies 6, 8 is effected by a control device 18 which is illustrated symbolically in FIG. 2.

The force-controlled processing assembly 6 counteracts the taper or the longitudinal curvature by a reference force F which is determined on the basis of the geometry of the rolled item 4. In FIG. 2, only the processing assembly 6 comes into contact with the rolled item 4, while the second processing assembly 8 is moved to a distance from the rolled item 4.

However, the two processing assemblies 6, 8 are advantageously configured such that the position-controlled processing assembly 8 tracks the force-controlled processing assembly 6, while the offset Δs remains constant. A reference force F which is specified to the method or the closed-loop control device for reducing the strip curvature, but is too great and may result in an unwanted longitudinal curvature of the rolled item 4, is equalized in this way. For the implementation in terms of closed-loop control engineering, this means that the midpoint 14 is predetermined and only the separation S between the processing assemblies 6, 8 is changed in order to reach and maintain the reference force F for as long as necessary. In particular, a method for adjusting a specific longitudinal curvature as per W02009/016086 is used for processing the rolled item in this case.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in Superguide v. DIRECTV, 69 USPQ2d 1865 (Fed. Cir. 2004).

The invention claimed is:

1. A method for influencing a geometry of a rolled item in a controlled manner, comprising:

transforming the rolled item from an initial state into an intermediate or final state by rolling the rolled item with a rolling stand having a processing facility, the processing facility being a vertical stand, the processing facility comprising first and second processing assemblies, the first and second processing assemblies being provided respectively on opposite sides of the rolled item; and operating the first processing assembly in a force-controlled manner based on a reference force;

operating the second processing assembly in a position-controlled manner;

identifying a midpoint between the first and second processing facilities, the midpoint being at a predetermined position; and tracking the second assembly to the first processing assembly such that the midpoint between the first and second processing assemblies always remains at the predetermined position, wherein a taper and/or a longitudinal curvature of the rolled item is measured, and the reference force for force control is determined based on the taper and/or the longitudinal curvature.

2. The method as claimed in claim 1, wherein the midpoint between the first and second processing assemblies and a separation between the first and second processing assemblies are used as a basis for closed-loop control of the first and second processing assemblies.

3. The method as claimed in claim 2, wherein the midpoint between the first and second processing assemblies is predetermined, and force control of the first processing assembly is effected by adjusting the separation between the first and second processing assemblies.

4. The method as claimed in claim 1, wherein the midpoint is offset from a centerline of the rolling stand.

5. The method as claimed in claim 1, wherein the first processing assembly is initially separated from the rolled item, and the first processing facility is moved up to the rolled item in a position-controlled manner, and then, when a reaction force acting on the first processing assembly reaches a reference force, the first processing facility is switched over to be force controlled.

6. The method as claimed in claim 1, wherein if a position of the taper and/or a direction of the longitudinal curvature of the rolled item changes, the first processing facility is switched to be position-controlled and the second processing facility is switched to be force-controlled.

7. The method as claimed in claim 1, wherein the rolled item has a longitudinal curvature, the rolled item is rolled through the rolling stand such that a longitudinal axis of the rolled item extends along a center line of the rolling stand, the midpoint between the processing facilities is offset from the center line to correct the longitudinal curvature of the rolled item.

8. A non-transitory computer readable data storage medium, storing a machine-readable computer program which when executed by a computer causes the computer to perform the method claimed in claim 1.

9. A control device for influencing a geometry of a rolled item in a controlled manner, comprising:

a control device having a computer processor to:

control a rolling stand to roll the rolled item and transform the rolled item from an initial state into an intermediate or final state, the rolling stand having a processing facility, the processing facility being a vertical stand, the processing facility comprising first and second processing assemblies, the first and second processing assemblies being provided respectively on opposite sides of the rolled item; and control the first processing assembly in a force-controlled manner based on a reference force;

control the second processing assembly in a position-controlled manner;

identify a midpoint between the first and second processing facilities, the midpoint being at a predetermined position; and control the second assembly to track the first processing assembly such that the midpoint between the first and second processing assemblies always remains at the predetermined position.

* * * * *